US005289803A

United States Patent [19]

Matsushiro et al.

[11] Patent Number: 5,289,803

[45] Date of Patent: Mar. 1, 1994

[54] COOLING SYSTEM FOR A WATER COOLED INTERNAL COMBUSTION ENGINE

[75] Inventors: Ryuichi Matsushiro; Toru Kosuda, both of Okazaki; Sigeo Sasao; Hiroyuki Fukunaga, both of Nishio; Yasumasa Ikumi, Aichi, all of Japan

[73] Assignee: Nippon Soken, Inc., Nishio, Japan

[21] Appl. No.: 977,751

[22] Filed: Nov. 17, 1992

[30] Foreign Application Priority Data

Nov. 19, 1991 [JP] Japan ..... 3-303634

[51] Int. Cl.[5] ..... F01P 7/14

[52] U.S. Cl. ..... 123/41.1; 123/41.54; 236/34.5; 236/101 C

[58] Field of Search ..... 123/41.1, 41.15, 41.29, 123/41.54; 137/855; 236/34, 34.5, 101 A, 101 C

[56] References Cited

U.S. PATENT DOCUMENTS

| | | | |
|---|---|---|---|
| 4,461,342 | 7/1984 | Avrea | 123/41.54 |
| 4,982,704 | 1/1991 | Sliger | 123/41.1 |
| 5,135,049 | 8/1992 | Attinger et al. | 123/41.54 |

*Primary Examiner*—Noah P. Kamen

*Attorney, Agent, or Firm*—Cushman, Darby & Cushman

[57] ABSTRACT

A cooling system for a water cooled internal combustion engine for a vehicle includes an engine body having a water jacket therein. The system comprises a radiator and a pump chamber. The pump chamber is in communication with the water jacket. A water pump creates a flow of water into the water jacket. A first main conduit has an end connected to the water jacket at the engine outlet and another end connected to the radiator. A second main conduit has an end connected to the radiator and another end connected to the pump chamber. A reservoir tank is arranged at a position more elevated than the radiator, and a supplementation conduit connects a bottom portion of the reservoir tank with an upper part of the pump chamber. A thermostat valve is arranged between the second main conduit and the pump chamber at a position upstream from a location where the supplementation conduit is connected to the pump chamber. A check valve is arranged in parallel with the thermostat valve and allows the introduction of air from the pump chamber to the second main conduit while preventing a flow of the air from the second main conduit to the pump chamber. The check valve is in a normally closed position under the force of gravity and is switchable to an opened position in response to a predetermined amount of air pressure in the pump chamber.

6 Claims, 3 Drawing Sheets

COOLING SYSTEM FOR A WATER COOLED INTERNAL COMBUSTION ENGINE

BACKGROUND OF THE INVENTION

1. Field of the Invention

The present invention relates to an apparatus for cooling a water-cooled internal combustion engine for an automobile.

2. Description of Related Art

In a water cooled internal combustion engine, a cooling water line is provided for obtaining recirculated flow of the cooling water via a water jacket of an engine body. In order to obtain a forced flow of recirculated water, a water pump is arranged in a selected location of the cooling water line. The location of the water pump is usually acceptable anywhere in the line so long as recirculation of a desired amount of water can be obtained. However, it is usual practice that location at an upper part of the cooling water line for the water pump is usually avoided, since such a location may increase the possibility of an accumulation of air when an amount of the cooling water is introduced into the pump, causing the pump to be subjected to racing.

However, a slant arrangement of an engine body in an engine compartment has recently been often required from the view point of providing a more aesthetic appearance and for increasing space in a cabin.

SUMMARY OF THE INVENTION

An object of the present invention is to provide an engine cooling system, capable of preventing an accumulation of air in a pump chamber even if the water pump is located at a top portion of an engine body.

According to the present invention, a cooling system is provided for a water cooled internal combustion engine for a vehicle. The engine has an engine body with a water jacket therein. The system comprises a radiator and a pump chamber arranged at a top portion of the engine body. The pump chamber is in communication with the water jacket.

A water pump arranged in the pump is chamber for obtaining a forced flow of the water into the water jacket.

A first main conduit has an end connected to the water jacket at an outlet of the engine for receiving the forced flow of the water from the engine water jacket and another end connected to the radiator for introducing the water into the radiator.

A second main conduit has an end connected to the radiator for receiving the water therefrom and another end connected to the pump chamber for introducing the flow of the water into the engine water jacket.

A reservoir tank is arranged at a position more elevated than the radiator, and a supplementation conduit connects a bottom portion of the reservoir tank with an upper part of the pump chamber.

A thermostat valve is arranged between the second main conduit and the pump chamber at a position upstream from a location where the supplementation conduit is connected to the pump chamber. The thermostat valve is responsive to a temperature of the cooling water for controlling the flow of the water in the radiator.

A check valve which is arranged in parallel with respect to the thermost at valve along the flow of the engine cooling water to allow an introduction of air from the pump chamber to the second main conduit while preventing a reverse flow of the air from the second main conduit to the pump chamber.

Due to the provision of the check valve, the present invention can prevent air from being accumulated in the pump chamber since the air in the pump chamber is evacuated via the check valve while preventing the evacuated air to be returned to the pump chamber. Thus, racing in the water pump, which might otherwise be caused by the residual air, is prevented.

BRIEF DESCRIPTION OF ATTACHED DRAWINGS

FIGS. 1 and 2 respectively show prior art constructions.

Figure 5:
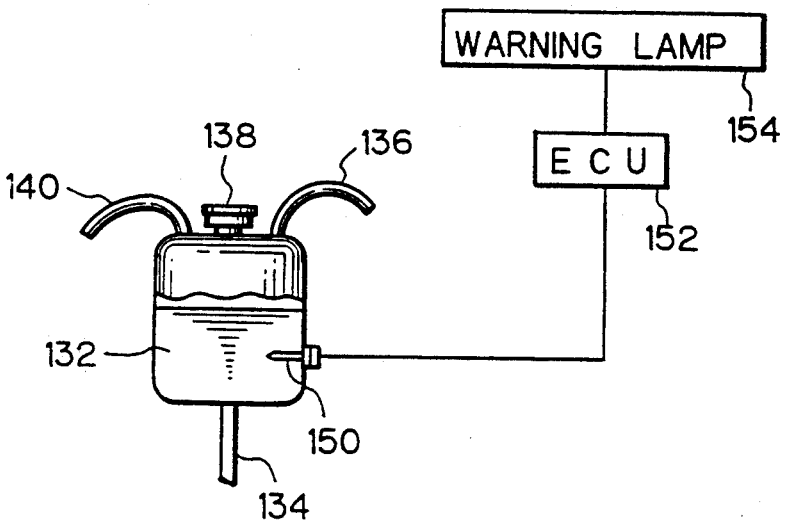

FIG. 5 partly shows a modification of the present invention.

Figure 4:
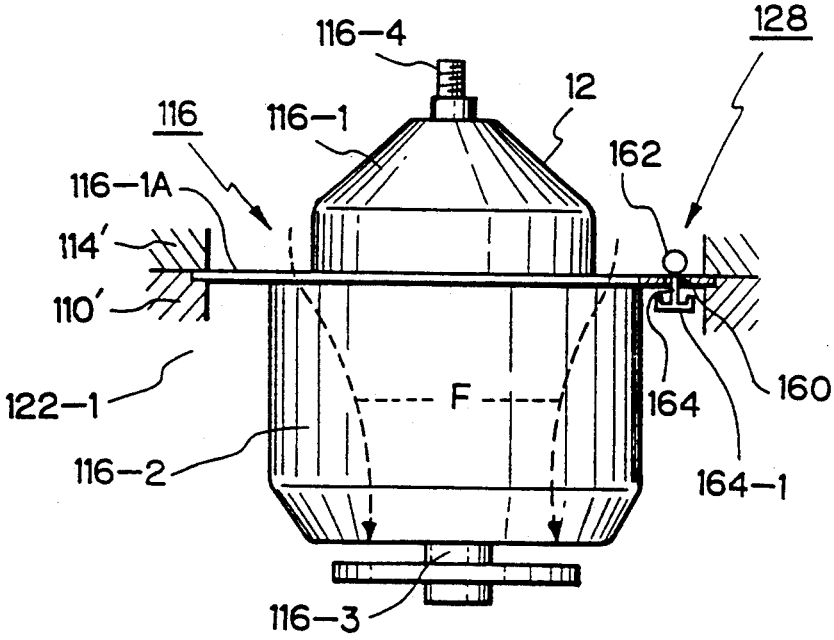
FIG. 4 shows a construction of a thermostat valve together with a jiggle valve, according to the present invention.
Figure 6:
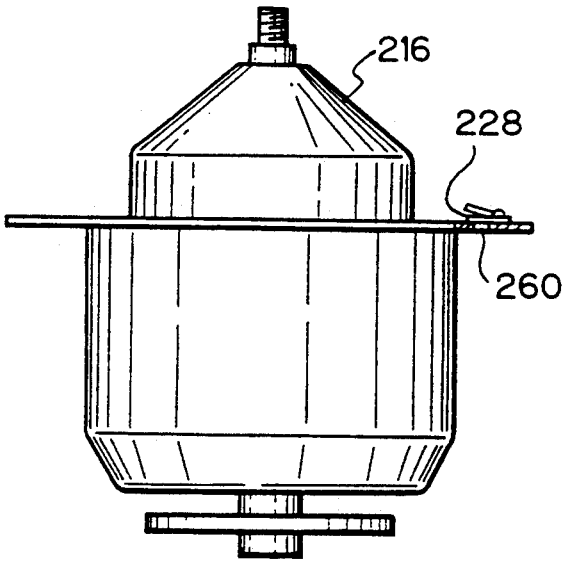

FIG. 6 is similar to FIG. 4, but is directed to a different embodiment of the present invention.

DETAILED DESCRIPTION OF PREFERRED EMBODIMENTS

Figure 1:
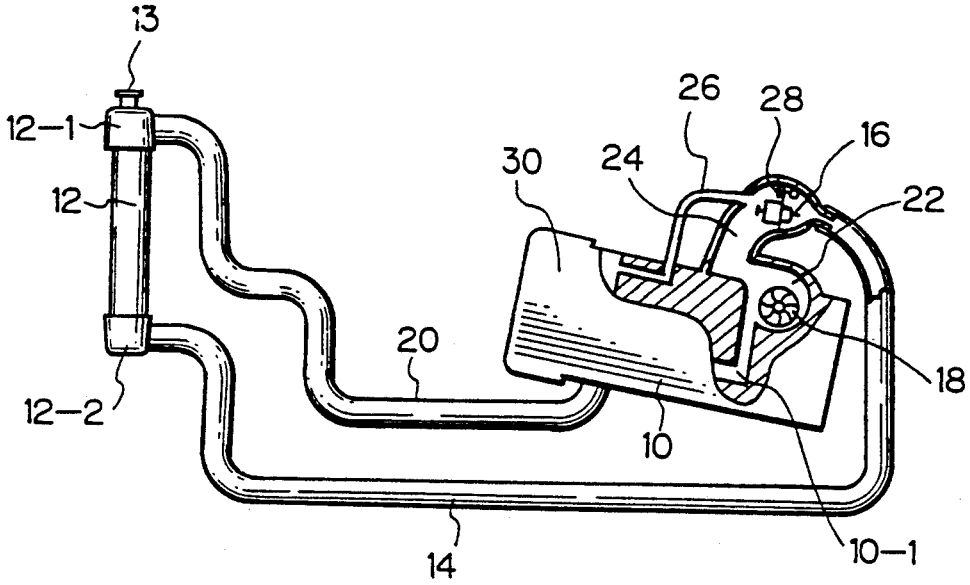
Fig. 1 PRIOR ART

Now, a problem to be solved by the present invention will be discussed in more detail with reference to FIGS. 1 and 2, which show prior art arrangements of a water cooled internal combustion engine. FIG. 1 shows a first example of a construction of a water cooled internal combustion engine in a prior art, wherein a body 10 of an internal combustion engine is greatly slanted with respect to a vertical plane. A radiator 12 is arranged in front of the engine body 10. The engine body is formed therein with a water jacket 10-1 through which engine cooling water is passed. The radiator 12 is provided with a top tank 12-1 with a radiator cap 13 and a bottom tank 12-2. A water outlet pipe 14 has a first end connected to the bottom tank 12-2 for taking up water being cooled at the radiator 12, and a second end connected to a thermostat valve 16. The thermostat valve 16 is connected, via a water pump 18, to the engine water jacket 10-1. A second water pipe 20 has a first end connected to the radiator 12 at its top tank 12-1 and a second end connected to the water jacket 10-1 in the engine body 10. A pump chamber 22 is created in the engine body 10, in which the water pump 18 is arranged. The pump chamber 22 is at its one end connected to a passageway 24 which is connected to the thermostat valve 16, and at the other end connected to an inlet side of the water jacket 10-1. A by-pass pipe 26 is at its one end connected to an outlet side of the water jacket 10-1, and at its other end connected to the passageway 24. As well known, the thermostat valve is in a closed condition when the temperature of the engine cooling water is lower than a predetermined value, which causes a flow of the engine cooling water that is created by the rotation of the water pump 18 via the by-pass pipe 26, and which prevents the cooling water from being introduced into the radiator 12. When the temperature of the engine cooling water is higher than the predetermined value, the thermostat valve 16 is opened, which allows a flow that is created via the pipe 14, the radiator 12 and the pipe 20, which allows the radiator to cool the cooling water. A jiggle valve 28 is arranged in parallel to the thermostat valve 16 at a position located above the valve 16. The jiggle valve is, as well known, usually in an open condition to allow the passage of a small amount of air. In this arrangement, the water pump 18 is located in the engine body at its top side portion.

When an amount of water is supplemented via the radiator cap 13 into the radiator 12, the water from the inlet pipe 14 can only be introduced into the pump chamber 22 via the jiggle valve 28 at its air opening, due to the fact that the thermostat 16 is closed due to the effect of gravity. It should be noted that the jiggle valve 28 is located at the top position of the inlet pipe 14, and therefore it can be moved into in its closed condition only when a pressure larger than a predetermined value exists in the inlet pipe 14 due to the rotation of the pump 18. In other words, the pressure increase caused by the supplementation of the engine cooling water via the cap 13 is not sufficient to close the jiggle valve 28. However, upon the supplementation of the water from the cap 13, only a small amount of engine water can pass through the air opening resulting from the opened condition of the jiggle valve 28 due to its gravity. As a result, the implementation of the water via the cap 13 causes the radiator 12 to be instantly and completely filled up, which causes an amount of the water to overflow into the outlet side pipe 20 and to the water jacket 10-1 in the engine body 10. This causes the air included in the engine cooling water located in the engine body to stay in the pump chamber 22 and or a top portion 30 of the engine body 10, due to the fact that there is no place for the air to escape. The residual air in the pump chamber 22 causes the water pump 18 to merely race, which prevents the engine cooling water to recirculate in the engine body, resulting in the engine being overheated.

Furthermore, even in a situation where there is no residual air in the pump chamber 22, the rotation of the water pump 18 due to the starting of the engine causes the residual air in the top portion of the cylinder head to be introduced into the pump chamber, which causes the water pump to race.

As a solution to the above problem, it will be easily conceivable to provide an air withdrawal plug at the top of the engine head 30, which is usually closed but is opened when the engine cooling water is supplemented so that the air is withdrawn when the engine cooling water is supplemented. However, this solution is not practical or effective since the typical user or mechanic cannot be expected to always open the air withdrawal plug each time upon the cooling water is supplemented. Furthermore, such an air withdrawal plug would have to be located at a position which is easily noticeable and accessible, which makes a provision of such a plug difficult. Thus, this solution is not a practical one.

Figure 2:
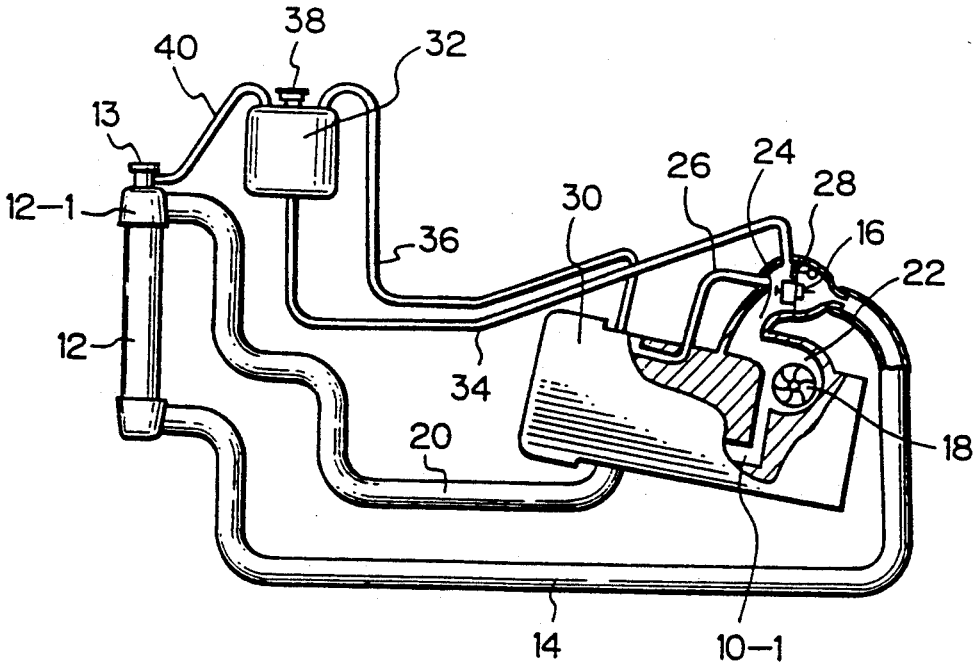
Fig. 2 PRIOR ART

An engine cooling system as shown in FIG. 2 is also known, wherein a provision is made for preventing the water pump 18 from racing due to the existence of residual air caused by the supplementation of the engine cooling water. This system includes, in addition to the construction shown in FIG. 1, a reservoir tank 32, which has a bottom opening connected, via a return pipe 34, to the passageway 24 at its top position, and a top opening connected via a engine vapor pipe 36, to a top portion of the water jacket 10-1 of the engine. The reservoir tank 32 is further provided with a cap 38 with a relief valve. When the water is supplemented to the radiator 12 via the cap 13, the air generated in the cooling water system is taken out into the reservoir tank 32 via the pipes 34 and 36, and is exhausted to the atmosphere from the reservoir tank 32 from which the cap 38 is removed.

It is, however, realized that the solution in FIG. 2 is not very effective for the following reason. Upon the supplementation of the water via the radiator cap 13 to the radiator 12, the water can rush into the pipes 34 and 36 via the reservoir tank 32, resulting in the water being accumulated in the portions of the pipes 34 and 36 which droop from the reservoir tank 32. This causes the relief passageway of the air in the pipes 34 and 36 to be closed, which makes it difficult for the air retaining in the pump chamber 22 to be evacuated. While elimination of the drooping portions of the pipes 34 and 36 can prevent this problem from occurring, such elimination drooping is difficult from a practical standpoint, since pipes 34 and 36 are located above most of the system so that it is quite natural that drooping portions are created.

In order to obviate the problem in the prior art in FIG. 2, it may be conceivable that the supplementation of the cooling water on carried out not through the radiator cap 13, but rather through the cap 38 with the relief valve at the top of the reservoir tank 32. In this case, the radiator cap 13 is kept closed, or eliminated. Also, in this case, the engine cooling water supplemented into the reservoir tank 32 via the cap 38 is introduced into the pump chamber 22 via the water return pipe 34, and is introduced into the water jacket 10-1 in the engine body via the outlet of the water pump 18. The water, after passing the water jacket 10-1, is gradually exhausted to the water outlet pipe 20 and is raised up to the upper tank 12-1 of the radiator 12. In this case, the air in the outlet pipe 20 is exhausted to a radiator vapor pipe 40 which connects upper tank 12-1 with the top portion of the reservoir tank 32. Since the upper tank 12-1 of the radiator 12 is located at a position higher than that of the pump chamber 22, the latter is filled up first. Then, when the level of the cooling water is increased to the level where thermostat 16 and jiggle valve 28 are located, is the water is then begins to be introduced into the inlet side water pipe 14 via the air vent holes of the jiggle valve 28, which is in an opened condition due to the effect of its own weight as in the prior art construction shown in FIG. 1.

However, only a limited amount of cooling water can pass through the vent air hole of the jiggle valve 28. As a result, a large amount of water flows into the outlet side cooling water pipe 20 so that the water is finally introduced into the upper tank 12-1 of the radiator 12, and flows into the inlet side cooling water pipe 14 via the heat exchanging part and the lower tank of the radiator 12. At this point, the air in the pipe 14, which is confined therein, is forced to return into the pump chamber 22. The opened condition of the jiggle valve 28 allows the air to be returned into the pump chamber 22 via the vent hole of the jiggle valve 28. As a result of the air remaining in the chamber 22, racing of the water pump 18 becomes inevitable when the engine is r-started.

In this case, a force of flow of the cooling water as supplemented into the reservoir tank 32 allows the cooling water to be introduced into the pipe 36 because of the existence of the drooping portion of the vapor pipe 36, which causes the passageway for removal of the air to be closed, so that an amount of air is accumulated in the top portion of the engine head 30. Such a residual air is introduced into the pump chamber 22 via the by-pass passageway 26, which can cause the drawback as explained above.

Figure 3:
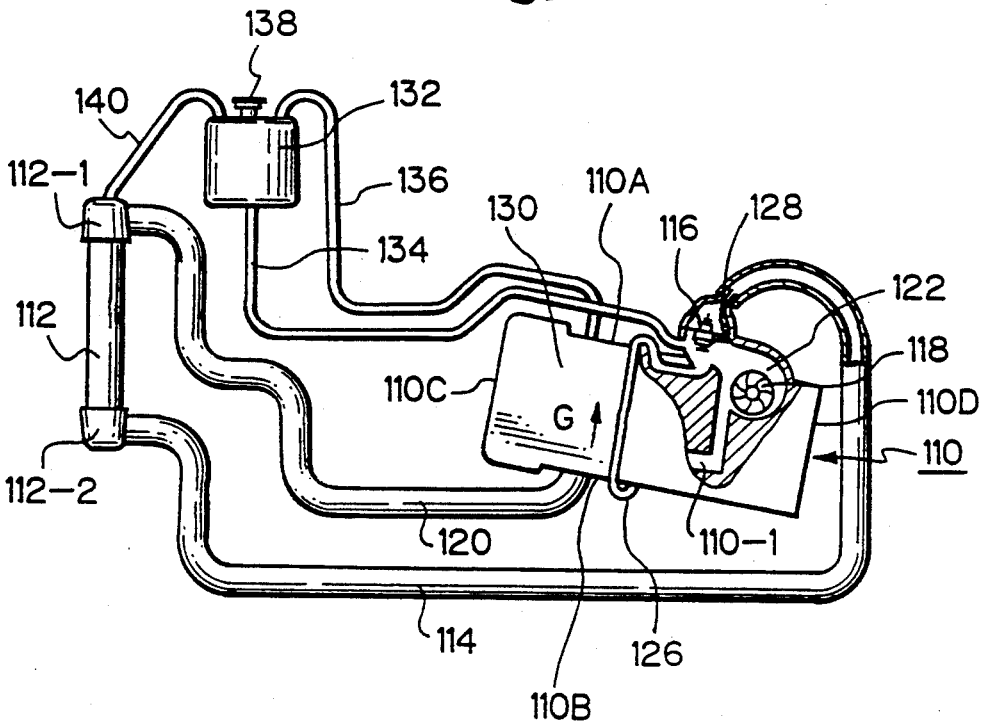
FIG. 3 shows a water cooling system according to the present invention.

A construction of the present invention which can overcome the above mentioned difficulties will now be explained with reference to FIG. 3. Similar to the prior art, an engine body 110 is a single-in-line multi-cylinder type. The engine body 110 has a pair of opposite, major surfaces 110A and 110B, and a pair of opposite, minor surfaces 110C and 110D, and extends transverse to the plane of the drawing in FIG. 3. In other words, the engine body 110 in FIG. 3 is shown in its lateral cross section. The engine body 110 is greatly slanted so that a pump chamber 122 is located at the top portion of the engine body 110. A water pump 118 is located in the pump chamber 122. The pump chamber 122 is, at its outlet, connected to a water jacket 110-1 formed in the engine body 110. A by-pass passageway 126 is provided, which has a first end connected to the pump chamber 122 at a position upstream from the pump 118 and a second end connected to the bottom portion of the water jacket 110-1 in the engine body 110.

A radiator 112 is provided with an upper tank 112-1 and a lower tank 112-2. The upper tank 112-1 is located at a position higher than the pump chamber 122. An inlet pipe 114 for introduction of the cooling water has a first end connected to the lower tank 112-2 of the radiator 112 and a second end connected to the pump chamber 122. An outlet pipe 120 has a first end connected to the bottom portion of the cooling water jacket 110-1 in the engine body 110, and a second end connected to the upper tank 112-1 of the radiator. At the inlet to the pump chamber 122 from the water inlet pipe 114, a thermostat 116 for controlling the flow of the cooling water into the pump chamber 122 is arranged together with a jiggle valve 128 as a check valve which is in parallel with the thermostat 116. In detail, as shown in FIG. 4, the thermostat 116 is provided with an upper case 116-1 and a lower case 116-2, which are connected with each other. Namely, the upper case 116-1 has a flange plate 116-1A, to which the upper end of the lower case 116-2 is connected by, for example, crimping, and the flange plate 116-1A is, at its outer edge, sandwiched between an end 114, of the pipe 114 and an end 110' of the engine body 110. Furthermore, according to this embodiment, the thermostat 116 generally extends almost vertically so that a vertical flow of cooling water is obtained when the thermostat 116 is opened. (Contrary to this, in the prior art in FIG. 1 or 2, the thermostat 16 extends almost horizontally, so that a horizontal flow of the engine cooling water is obtained.) The thermostat 116 is provided with a valve member 116-3, which has a portion extending inwardly in the lower case 116-2 to a valve portion (not shown). The thermostat 116 is further provided with a rod 116-4, which has a portion extending inwardly in the upper case 116-1 to a sliding member (not shown) connected to the valve portion (not shown) of the valve member 116-3 via a wax (not shown). As well known to those skilled in this art, a high temperature of the engine cooling water causes the wax to be expanded, so that the valve member 116-3 is moved allowing the flow of the engine cooling water from the inlet pipe 114 to the engine water jacket via the water pump 118 as shown by dotted arrows F. Contrary to this, a low temperature of the engine cooling water causes the wax to contract, so that the valve member 116-3 is moved preventing the flow of the engine cooling water from the inlet pipe 114 to the engine water jacket via the water pump 118.

As shown in FIG. 4, the flange plate 116-1A forms an air vent hole 160 at a position adjacent the inner wall of the cooling water passageway in the engine body, and the jiggle valve 128 is constructed by a ball 162 as a weight and a stopper rod 164. The ball 162 is located on the upper side of the plate 116-1A so that the ball 162 is by the effect of gravity seated on the edge of the hole 160 to normally shut off the air vent hole 160. The rod 164 has an upper end connected to the ball 162 and a bottom end of a flange shape portion 164-1 with notches which can engage the plate 116-1A from its lower side for preventing the jiggle valve 128 from being withdrawn while allowing a small amount of water to pass therethrough. As will be easily understood, the weight of the ball 162 normally causes it to be seated on the edge of the vent hole 160 to close it, and a pressure in the pump chamber 122 generated during the supplementation of the cooling water causes the ball 162 to be moved away from the edge of the vent hole 160 to open it for removal of the air.

During the operation of the engine, a temperature of the engine cooling water lower than a predetermined value causes the thermostat valve 116 to assume a closed position, which prevents the cooling water from recirculating in the radiator 112, and rather allows the cooling water to recirculate through the by-pass passageway 126 by the rotation of the water pump 118 as shown by an arrow G in FIG. 3. During the closed condition of the thermostat valve 116, due to the rotation of the water pump 118, the jiggle valve 128 maintains its closed position.

A temperature of the engine cooling water higher than the predetermined value causes the thermostat valve 116 to assume an opened position, which allows the cooling water to be introduced into the water jacket 110-1 from the pump 118. The engine cooling water after passing through the water jacket 110-1 is delivered to the outlet passageway 120 and to the radiator 112. After the emission of the heat at the radiator 112, the cooling water is delivered to the inlet side passageway 114 and to the pump chamber 122. It should be noted that, during the opened condition of the thermostat valve 116, pressure of the cooling water in the inlet side passageway 114 acts on the ball 162 of the jiggle valve 128, which causes the vent opening 160 to be shut off.

The reservoir tank 132 is located above the radiator 112. Similar to the prior art in FIG. 2, the reservoir tank 132 has at its top portion a cap 138 with a relief valve (not shown). The reservoir tank 14 is, at its bottom, connected to the inlet side of the water jacket in the engine body 110, i.e., the inlet side of the pump chamber 122 downstream from the thermostat valve 116 by means of a return pipe 134 as a cooling water supply pipe. The reservoir tank 132 is, at its top portion, connected to the top portion of the water jacket in the engine body 110 via the engine vapor pipe 136. Furthermore, the reservoir tank 132 is connected to the upper tank 112-1 of the radiator 112 via a radiator vapor pipe 140. Thus, the vapor of the engine cooling water obtained in the engine cooling water recirculation system is introduced into the reservoir tank 132 at its top portion via the vapor passageways 136 and 140, and is then cooled at the reservoir tank 132 and re-introduced into the engine cooling water recirculating system from the bottom of the tank 132 via the return pipe 134.

In the above embodiment of the present invention, a supplementation of the engine cooling water is carried out through the cap 138 of the reservoir tank 132 when the engine is completely stopped. The water as supplemented is, from the reservoir tank 132, introduced into the pump chamber 122 via the return pipe 134, and is introduced into the water jacket 110-1 inside the engine body 110. As the level of the engine cooling water increases, the air remaining in the pump chamber causes the ball valve 162 to be displaced upwardly, which causes the air to be introduced into the inlet side water supply pipe 114. At this point, both the inlet pipe 114 and radiator 112 are empty, and therefore, the air as introduced is instantly discharged to the atmosphere via the radiator vapor pipe 140 and the reservoir tank 132.

After the engine body 110 is filled by the cooling water, the water is then introduced into the outlet side water pipe 120, and is moved gradually to the upper tank 112-1 of the radiator 112, which also causes the air remaining in the pipe 120 to be discharged into the atmosphere via the radiator vapor pipe 140 and the reservoir tank 132. During such process, since the upper tank 112-1 is located above the pump chamber 122, the latter chamber is completely filled up faster than the upper tank 112-1 is. The water filling the pump chamber 122 causes the jiggle valve 162 to be displaced upwardly against gravity, so that a small amount of the cooling water starts to be delivered to the inlet side water pipe 114 via the vent hole 160. However, the amount of the water flowing through the jiggle valve 128 is limited, and therefore, almost of all of the water as supplemented is directed to the outlet side pipe 120 rather than being directed to the inlet side pipe 114. Thus, the water in the pipe 120 finally reaches the upper tank 112-1 of the radiator 112, and is directed to the inlet side pipe 114 via the heat exchanging portion and the lower tank 112-2 of the radiator.

At this instant, when the water from the above begins to be entered into the inlet side pipe 114, the air remaining in the pipe 114 is confined thereat, and is urged toward the jiggle valve 128. However, the jiggle valve 128 is situated so that it assumes a closed position by means of the pressure of the residual air in the inlet pipe 114 and its own weight, and therefore, the air in the water inlet pipe 114 is prevented from being flown back into the pump chamber 122, which allows the pump chamber 122 to be fully filled only by the water. In other words, a small amount of air is confined inside the pipe 114 rather than a pump chamber 122.

Upon the completion of the supplementation of the cooling water, the air remaining in the pipe 114 is prevented from being introduced into the pump chamber 122 until a warming up operation of the engine is finished due to the fact the thermostat valve 116 is normally closed. If the thermostat valve 116 is opened upon the completion of the warming up operation, the air remaining in the upper portion of the inlet side pipe 114 is, only gradually introduced into the pump chamber 122, due to the fact that the cooling water of a higher specific weight is, with priority, sucked into the pump chamber 122 because the pressure at the reservoir tank 132 always acts on the pump chamber 122 via the return pipe 134. As a result, the residual air in the pipe upon the completion of the warming-up operation is prevented from being instantly introduced into the chamber 122 when the thermostat 116 is opened. As a result, an occurrence of racing of the water pump 118 is prevented.

When the thermostat valve 116 is closed during the time the engine is being warmed up, the by-pass pipe 126 allows the engine cooling water to be solely introduced into the pump chamber 122 upon the rotation of the pump 118, since the by-pass pipe 126 is connected to the bottom portion of the water jacket 110-1 in the engine body 110 where the engine cooling water is always located. As a result, any racing of the water pump 118 is prevented.

As explained above, according to the present invention, upon the supplementation of the water, the jiggle valve 128 allows the air in the pump chamber 122 to be delivered to the inlet side pipe 114, while operating as a check valve for preventing the air in the pipe 114 to be return back into the pump chamber 122, so that the air is prevented from being accumulated in the pump chamber 122 and the water jacket of the engine body 110. Thus, unlike the prior art shown in FIGS. 1 and 2, irrespective of the fact that the water pump 118 is located at the top portion of the engine body 110, an overheating of the engine which would otherwise be caused by the residual air is positively prevented.

FIG. 5 shows a modification of the embodiment in FIG. 3, wherein the reservoir tank 132 is provided with a sensor 150 for detection of the level of the water in the reservoir tank, and the level sensor 150 is connected to an electronic control unit 152 as a micro-computer system, which is connected to an alarm lamp 154 which is arranged on a place which is easy for a driver to check. The level of the water in the reservoir tank 132, which is lower than a predetermined value, is determined by the electronic control unit 152 for operating an alarm lamp. Thus, the driver is reminded to supplement the water to the reservoir tank, which prevents the water pump from racing. Even if a certain amount of air remains in the top portion of the engine head or the top portion of the pipe, such air gradually escapes to the reservoir tank via the vaper pipe 136, 140 as already explained with reference to FIG. 3. Such a removal of the air causes the level of the water in the reservoir tank to be correspondingly reduced. Thus, in the situation where the level of the water is initially low, due to an insufficient and erroneous supplementation process, such a reduction in the water level in the reservoir tank 132 during the engine operation causes the air in the reservoir tank 132 to be sucked into the engine 110, which may cause the water pump 118 to race. The embodiment in FIG. 5 may exclude this possibility since the alarm system can detect the actual level of the water in the reservoir tank 132 to provide an alarm signal.

FIG. 6 is similar to FIG. 4, but is directed to another embodiment, wherein in place of the jiggle valve 128 as a check valve, a reed valve 228 is provided so that it is in parallel with respect to a thermostat valve 216. The reed valve 228 is made as a thin metal plate member having a resiliency. The reed valve 228 is normally closed to close the air vent hole 260. The pressure in the pump chamber causes the reed valve 228 to be displaced against its resiliency, which allows the vent hole 260 to be opened for removal of the air in the pump chamber into the water inlet pipe (not shown in FIG. 6, but corresponding to the pipe 114 in FIG. 3).

For the check valve, any different construction can be employed so long as a similar function can be obtained.

A passageway for the check valve can be provided inside the thermostat valve, and the check valve is arranged in the inner passageway.

The idea of the present invention can be employed even in the case where the engine is not slanted at all.

We claim:

1. A cooling system for a water cooled internal combustion engine for a vehicle, the engine including an engine body with a water jacket therein, said system comprising:

a radiator;

a pump chamber disposed at a top portion of the engine body, the pump chamber being in fluid communication with the water jacket;

a water pump disposed in the pump chamber for creating a forced flow of water into the water jacket;

a first main conduit having an end connected to the water jacket at an outlet of the engine for receiving the forced flow of water from the engine water jacket and another end connected to the radiator for introducing the water into the radiator;

a second main conduit having an end connected to the radiator for receiving the water therefrom and another end connected to the pump chamber for introducing the flow of water into the engine water jacket;

a reservoir tank disposed at a position more elevated than the radiator;

a supplementation conduit for connecting a bottom portion of the reservoir tank with an upper part of the pump chamber;

a thermostat valve arranged between the second main conduit and the pump chamber at a position upstream from a location at which the supplementation conduit is connected to the pump chamber, the thermostat valve controlling the flow of water in the radiator in response to a temperature of the water; and a check valve arranged in parallel with the thermostat valve for allowing an introduction of air from the pump chamber to the second main conduit while preventing a flow of the air from the second main conduit to the pump chamber, said check valve comprising a fixed plate member extending transverse to the flow of the water from the second main conduit to the pump chamber and a resilient read valve member disposed on a side of the plate member remote from the pump chamber, said plate member having an edge defining a vent hole, said reed valve member being resiliently biased against said edge for maintaining said check valve in a normally closed position and being operable in response to a predetermined amount of air pressure in said pump chamber to open the check valve against the resiliency of the reed valve member.

2. A system according to claim 1, further comprising a first vapor pipe for connecting a top portion of the reservoir tank to a top portion of the water jacket, and a second vapor pipe for connecting the top portion of the reservoir tank to a top portion of the radiator.

3. A system according to claim 1, further comprising a sensor for detection of a level of the water in the reservoir tank and means for providing an alarm signal when the detected level becomes lower than a predetermined level.

4. A cooling system for a water cooled internal combustion engine for a vehicle, the engine including an engine body with a water jacket therein, said system comprising:

a radiator;

a pump chamber arranged at a top portion of the engine body, the pump chamber being in fluid communication with the water jacket;

a water pump arranged in the pump chamber for creating a forced flow of water into the water jacket;

a first main conduit having an end connected to the water jacket at an outlet of the engine for receiving the forced flow of water from the engine water jacket and another end connected to the radiator for introducing the water into the radiator;

a second main conduit having an end connected to the radiator for receiving the water therefrom and another end connected to the pump chamber for introducing the flow of water into the engine water jacket;

a reservoir tank arranged at a position more elevated than the radiator;

a supplementation conduit for connecting a bottom portion of the reservoir tank with an upper part of the pump chamber;

a thermostat valve arranged between the second main conduit and the pump chamber at a position upstream from a location where the supplementation conduit is connected to the pump chamber, the thermostat valve controlling the flow of water in the radiator in response to a temperature of the water;

a check valve arranged in parallel with the thermostat valve, the check valve being arranged for allowing an introduction of air from the pump chamber to the second main conduit while preventing a flow of air from the second main conduit to the pump chamber, said check valve being in a normally closed position under the force of gravity and being switchable to an opened position in response to a predetermined amount of air in the pump chamber; and a by-pass conduit for connecting the water jacket at a bottom portion thereof with the upper part of the pump chamber to enable recirculation of the water through the by-pass conduit when the thermostat is in its closed position.

5. A system according to claim 4, wherein said check valve comprises a fixed plate member extending substantially transverse to the flow of the water from the second main conduit to the pump chamber, a ball member located on one side of the plate member remote from the pump chamber, the plate member defining a vent hole, the ball member normally resting on an edge of the vent hole under the force of gravity for closing the vent hole, the air pressure in the pump chamber displacing the ball for opening the vent hole against the weight of the ball when said predetermined amount of air pressure exists in said pump chamber.

6. A system according to claim 5, wherein the check valve further comprises a stopper member for limiting the displacement of the ball member while permitting a passage of water thereby.

* * * * *